United States Patent [19]

Gross

[11] Patent Number: 4,988,353

[45] Date of Patent: Jan. 29, 1991

[54] DEPILATORY DEVICE AND HAIR-PLUCKER BODY FOR USE THEREIN

[75] Inventor: Joseph Gross, Moshav Mazor, Israel

[73] Assignee: Hair Remover Ltd., Tel-Aviv, Israel

[21] Appl. No.: 429,237

[22] Filed: Oct. 30, 1989

[30] Foreign Application Priority Data

Nov. 11, 1988 [IL] Israel ..... 88361
May 19, 1989 [IL] Israel ..... 90347

[51] Int. Cl.[5] ..... A61B 17/50
[52] U.S. Cl. ..... 606/133; 452/84
[58] Field of Search ..... 606/133; 17/11.1 R, 17/47

[56] References Cited

U.S. PATENT DOCUMENTS 4,524,772 6/1985 Daar et al. ..... 606/133
4,726,375 2/1988 Gross et al. ..... 606/133
4,807,624 2/1989 Gross et al. ..... 606/133
4,825,867 5/1989 Gross et al. ..... 17/11.1 R

*Primary Examiner*—C. Fred Rosenbaum
*Assistant Examiner*—William W. Lewis
*Attorney, Agent, or Firm*—Benjamin J. Barish

[57] ABSTRACT

A depilatory device includes a flexible plastic cylindrical member formed with a plurality of circumferentially-extending slits, the plastic member being rotated about its longitudinal axis while supported in an arcuate position such that the slits open and close during rotation of the plastic member to receive and pluck the hairs. The plastic member includes a high-strength flexible core imparting mechanical strength, and the slits are formed with corrugated or otherwise non-planar faces to enhance their gripping power when the slits are closed.

20 Claims, 1 Drawing Sheet

DEPILATORY DEVICE AND HAIR-PLUCKER BODY FOR USE THEREIN

BACKGROUND OF THE INVENTION

The present invention relates to depilatory devices, and also to hair-plucker bodies used in such devices, and particularly to improvements in or modifications to the depilatory devices described in U.S. Pat. Nos. 4,726,375 and 4,807,624.

U.S. Pat. No. 4,726,375 describes a depilatory device for removing body hair, comprising a manually-grippable housing, and a hair-plucker body rotatably mounted to the housing and having an exposed section formed with a plurality of gaps in its outer surface which open and close during the rotation of the hair-plucker body to receive, pluck, and eject body hair growing on a surface over which the hair-plucker body is moved. The hair-plucker body is a flexible cylindrical member of plastic (preferably elastomeric) material having a smooth outer surface formed with a plurality of slits penetrating only partially through the plastic member and extending circumferentially thereof. The plastic member is rotated about its longitudinal axis and is supported in an arcuate position such that the slits open at the convex side of the plastic member during its rotation to receive hairs between the open confronting faces of the slits, and close at the concave side to clamp the hairs between the closed confronting faces of the slits.

OBJECTS AND SUMMARY OF THE INVENTION

An object of the present invention is to provide a depilatory device, and a hair-plucker body for use in such device, of the above type but having advantages in a number of respects, as will be described more particularly below.

According to one aspect of the present invention, there is provided a depilatory device of the above type characterized in that the flexible cylindrical member includes a high-strength flexible core of a material different from, and substantially stronger than, said plastic cylinder member imparting mechanical strength to the member and thereby permitting its diameter to be reduced in order to catch short hairs, and/or permitting the slits to be formed deeper and/or more densely therein in order to catch more hairs.

Preferably, the slits extend in depth substantially to the core, but may terminate short of the core.

In one described embodiment, the slits extend for less than one-half of the complete circumference of the plastic cylindrical member; and in a second described embodiment, they extend for its complete circumference.

The high-strength core is preferably a plastic filament such as nylon, but it is contemplated that it could be a metal wire, such as steel.

The invention also provides a hair-plucker body as described above for use with a depilatory device.

According to another aspect of the invention, there is provided a hair-plucker body for depilatory device of the type described in U.S. Pat. No. 4,726,375 in which at least some of the slits include non-planar faces to enhance their gripping power when the slits are closed. Preferably, the faces of the slits are formed with corrugations. By thus enhancing the gripping power of the slits, the device is capable of catching shorter and finer hairs.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
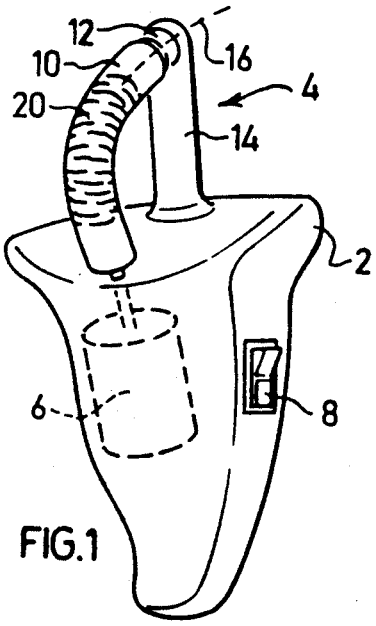
FIG. 1 is a three-dimensional view illustrating a depilatory device of the type described in U.S. Pat. No. 4,726,375.

The depilatory device illustrated in FIG. 1 comprises a manually-grippable housing 2, and a hair-plucker body 4 rotatably mounted to the housing and rotated by an electric motor 6. Motor 6 is disposed within housing 2 and is energized and deenergized by an electrical switch 8. The rotatable hair-plucker body 4 is in the form of a plastic cylindrical member 10 having one end received within housing 2 and coupled to the electric motor 6, and an opposite end received within a bearing 12 mounted at the end of a stem 14 projecting axially of housing 2. The arrangement is such that the plastic cylindrical member is supported in the form of a small arc, preferably less than 90° (e.g. 60°), and is rotated about its longitudinal axis 16.

Plastic cylindrical member 10 is of a flexible plastic material (preferably rubber or other elastomer) of solid construction and includes a smooth outer surface formed with a plurality of slits 20 extending partially through the member.

Figure 2:
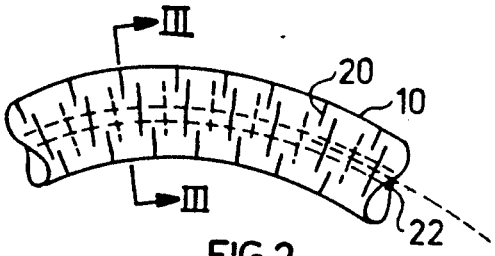
FIG. 2 is an enlarged fragmentary view illustrating one construction of the hair-plucker body in accordance with the present invention.
Figure 3:
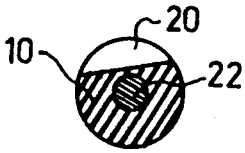
FIG. 3 is a sectional view along lines III—III of FIG. 2.

FIGS. 2 and 3 illustrate one preferred construction of the plastic cylindrical member 10. In this construction, member 10 is formed with a central high-strength flexible core 22, and each slit 20 extends circumferentially of member 10 for a length less than its complete circumference, preferably for about, or less, than one-half its complete circumference.

Core 22 is of a high-strength material to impart mechanical strength to the plastic cylindrical member 10. For example, core 22 may be of a high-strength plastic filament, such as nylon, or of a high-strength metal wire, such as steel or copper.

The provision of the high-strength flexible core 22 permits the diameter of the plastic cylindrical member 10 to be significantly reduced, which enables the member to catch shorter hairs. Thus, in the commercial version without the core, the plastic cylindrical member is about 4–5 mm in diameter; the provision of the core 22 enables the diameter to be reduced by 1 or 2 mm. This permits the device to catch and pluck shorter hairs that might be missed with the larger-diameter member.

The provision of the high-strength flexible core 22 further permits the slits 20 to be formed deeper, and/or more densely, which enables the flexible cylindrical member 10 to catch more hairs. Thus, by forming the slits deeper, the gaps open wider; and by forming them closer together, the number of gaps is increased per unit length in contact with the user's skin, thereby enabling the device to catch and pluck more hairs in a shorter period of time.

As shown in FIG. 2, the slits 20 are formed at right angles to the longitudinal axis 16 of the plastic cylindrical member 20, in its straight unbent condition, and are disposed in a helical pattern around the cylindrical member. Preferably, the slits extend in depth substantially to the core 22, or slightly short of the core.

Figure 4:
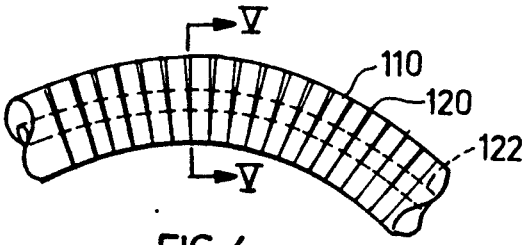
FIG. 4 is an enlarged fragmentary view illustrating another construction of the hair-plucker body in accordance with the present invention.
Figure 5:
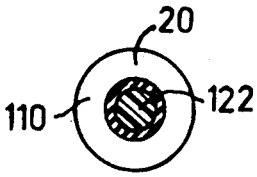
FIG. 5 is a sectional view along line V—V of FIG. 4.

FIGS. 4 and 5 illustrate another construction, wherein the plastic cylindrical member, therein designated 110, is formed with continuous annular slits 120 extending for the complete circumference of the member. This arrangement thus resembles individual discs carried by the high-strength core 122, similar to the construction described in our U.S. Pat. No. 4,807,624.

Both constructions of FIGS. 2, 3 and 4, 5 may be conveniently manufactured by extrusion of the material forming the plastic cylindrical member (10 or 110) over the high-strength core (22 or 122), and then cutting the slits therein, either the separate descrete slits 20 as illustrated in FIG. 2 or 3, or the continuous annular slits 120 as illustrated in FIGS. 4 and 5.

Figure 6:
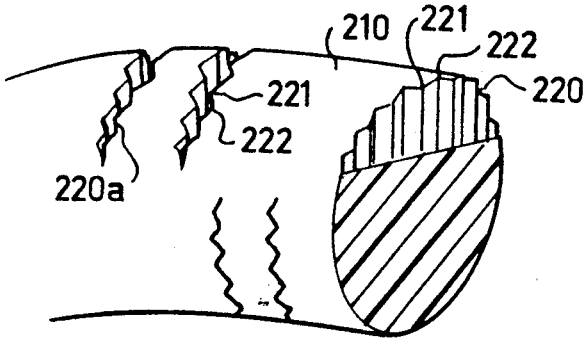
FIG. 6 is an enlarged fragmentary view illustrating one construction in accordance with the present invention of some or all of the slits in the hair-plucker body of the device of FIG. 1.
Figure 7:
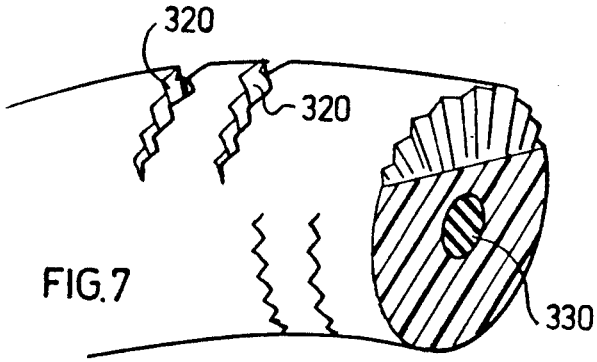
FIG. 7 is a view similar to that of FIG. 6, but illustrating this slit construction applied to a hair-plucker body including a high-strength flexible core.

FIGS. 6 and 7 illustrate variations wherein at least some, and preferably all, the slits include non-planar faces to enhance their gripping power when the slits are closed.

In FIG. 6, the cylindrical member 210 is formed with slits 220 having corrugations which extend generally in the radial direction. Such corrugations may be made, for example, by using slitter blades which are formed with corrugations extending generally perpendicularly to the cutting edge of the blade. In such case, the corrugations would extend parallel to each other along chord lines with respect to member 210. The slitter blades are moved in the radial direction into the cylindrical member and may be rapidly vibrated through very short strokes (much less than the spaces between the corrugations) to facilitate slitting.

As shown particularly in FIG. 6, the corrugations 220 are formed with alternating ridges 221 and grooves 222 which, when the slit is closed, mate with the corresponding grooves and ridges in the opposite face of the slit to firmly grip any hair caught within the slit. FIG. 6 illustrates the slits at the convex side of the cylindrical member 210 in their open condition at **220*a*, and at the concave side of the member in their closed condition at 220*b***.

FIG. 7 illustrates the above construction of slits 320 formed in a plastic cylindrical member 310 of the type described in FIGS. 1–5 above, namely including a high-strength flexible core 330, such as of a high-strength plastic filament (e.g., nylon), or of a high-strength metal wire (e.g., steel or copper).

While the invention has been described with respect to several preferred embodiments, it will be appreciated that many other variations, modifications and applications of the invention may be made.

What is claimed is:

1. A depilatory device for removing body hair, comprising: a manually-grippable housing, and a hair-plucker body rotatably mounted to the housing and having an exposed section formed with a plurality of gaps in its outer surface which open and close during the rotation of the hair-plucker body to receive, pluck, and eject body hair growing on a surface over which the hair-plucker body is moved; said hair-plucker body being a flexible cylindrical member of plastic material having a smooth outer surface formed with a plurality of slits penetrating only partially through the plastic cylindrical member and extending circumferentially thereof; said plastic cylindrical member being rotated about its longitudinal axis and being supported in an arcuate position such that said slits open at the convex side of the plastic cylindrical member during its rotation to form said gaps which receive the hairs between the open confronting faces of the slits, and close at the concave side to clamp the hairs between the closed confronting faces of the slits; characterized in that said flexible cylindrical member includes a high-strength flexible core, of a material different from, and substantially stronger than, said plastic cylinder member, imparting mechanical strength to the member and thereby permitting its diameter to be reduced in order to catch short hairs, and/or permitting the slits to be formed deeper and/or more densely in order to catch more hairs.

2. The device according to claim 1, wherein said slits extend in depth substantially to said high-strength flexible core.

3. The device according to claim 1, wherein said slits extend for less than one-half the complete circumference of the plastic cylindrical member.

4. The device according to claim 1, wherein said slits are annular slits and extend for the complete circumference of the plastic cylindrical member.

5. The device according to claim 1, wherein said high-strength flexible core is a plastic filament.

6. The device according to claim 5, wherein said plastic filament is nylon.

7. The device according to claim 1, wherein said high-strength flexible core is a metal wire.

8. The device according to claim 7, wherein said metal wire is steel.

9. The depilatory device according to claim 1, characterized in that at least some of said slits are formed with non-planar faces to enhance their gripping power when the slits are closed.

10. The device according to claim 9, wherein said faces are formed with corrugations.

11. The device according to claim 10, wherein said corrugations extend generally in the radial direction.

12. The device according to claim 10, wherein said corrugations are substantially parallel to each other and extend along chord lines with respect to the cylindrical member.

13. A hair-plucker body in the form of a flexible cylindrical member of plastic material having a plurality of slits defining gaps on its outer surface which, when the hair-plucker body is supported in an arcuate position and is rotated about its longitudinal axis, open at the convex side of the plastic cylindrical member during its rotation, and close at the concave side to clamp and pluck the hairs; characterized in that said flexible cylindrical member includes a high-strength flexible core, of a material different from, and substantially stronger than, said plastic cylinder member, imparting mechanical strength to the member and thereby permitting the diameter of the member to be reduced in order to catch short hairs, and/or the slits to be formed deeper and/or more densely in order to catch more hairs.

14. The hair plucker-body according to claim 13, wherein said slits extend in depth substantially to said high-strength flexible core.

15. The hair-plucker body according to claim 13, wherein at least some of said slits are formed with non-planar faces to enhance their gripping power when the slits are closed.

16. The hair-plucker body according to claim 15, wherein said non-planar faces are corrugated.

17. A hair-plucker body in the form of a flexible cylindrical member of plastic material having a plurality of slits penetrating only partially through the plastic cylindrical member and extending circumferentially thereof for less than one-half the complete circumference of said plastic cylindrical member to define gaps on its outer surface which, when the hair-plucker body is supported in an arcuate position and is rotated about its longitudinal axis, open at the convex side of the plastic cylindrical member during its rotation, and close at the concave side to clamp and pluck the hairs; characterized in that at least some of said slits are formed with non-planar faces to enhance their gripping power when the slits are closed.

18. The hair-plucker body according to claim 17, wherein said non-planar faces are corrugated.

19. The hair-plucker body according to claim 17, wherein said flexible cylindrical member includes a high-strength flexible core imparting mechanical strength to the member and thereby permitting the diameter of the member to be reduced in order to catch short hairs, and/or the slits to be formed deeper and/or more densely in order to catch more hairs.

20. The hair-plucker body according to claim 19, wherein said slits extend in depth substantially to said high-strength flexible core.

* * * * *